US011299246B1

(12) United States Patent
Chen et al.

(10) Patent No.: US 11,299,246 B1
(45) Date of Patent: Apr. 12, 2022

(54) PROPELLER ASSEMBLY WITH NOISE REDUCING HUB ARRANGEMENT

(71) Applicant: Turning Point Propellers, Inc., Jacksonville, FL (US)

(72) Inventors: Liheng Chen, Jacksonville, FL (US); Phil Stephanuik, Jacksonville, FL (US)

(73) Assignee: Turning Point Propellers, Inc., Jacksonville, FL (US)

( * ) Notice: Subject to any disclaimer, the term of this patent is extended or adjusted under 35 U.S.C. 154(b) by 0 days.

(21) Appl. No.: 17/154,492

(22) Filed: Jan. 21, 2021

(51) Int. Cl.
*B63H 1/20* (2006.01)

(52) U.S. Cl.
CPC ..... *B63H 1/20* (2013.01)

(58) Field of Classification Search
CPC . B63H 5/07; B63H 1/00; B63H 23/34; B63H 1/20; B63H 2023/342; F16F 15/1216
See application file for complete search history.

(56) References Cited

U.S. PATENT DOCUMENTS 6,158,960 A 12/2000 Marsi
6,609,892 B1 8/2003 Kreul et al.
6,659,818 B2 12/2003 Booe
7,008,188 B2 3/2006 Booe, Jr.
7,223,073 B2 5/2007 Dean
7,708,526 B2 * 5/2010 Chen ..... B63H 23/34 416/134 R
7,717,678 B2 5/2010 Chen
8,277,269 B1 10/2012 Alby et al.
10,864,974 B2 * 12/2020 Stephanuik ..... B63H 1/20
2002/0009367 A1 * 1/2002 Chen ..... F16D 1/06 416/134 R
2002/0085914 A1 7/2002 Chen
2003/0118443 A1 * 6/2003 Chen ..... F16D 9/06 416/2
2005/0186861 A1 8/2005 Powers
2006/0263219 A1 * 11/2006 Dean ..... B63H 1/20 416/134 R
2008/0139061 A1 6/2008 Chen
2009/0075535 A1 3/2009 Un et al.
(Continued)

*Primary Examiner* — Shafiq Mian
(74) *Attorney, Agent, or Firm* — Boyle Fredrickson, S.C.

(57) ABSTRACT

A propeller assembly is provided for mounting on a rotatable propeller shaft having a terminal end. The propeller assembly includes a housing structure extending along a longitudinal axis and having first and second ends. The housing structure includes an inner surface defining a cavity and an opening in the second end in communication with the cavity. A bushing assembly has first and second ends and includes an outer surface engageable with the inner surface of the housing structure. An adaptor has first and second sides and is adapted for receipt on the propeller shaft. The adaptor has an enlarged portion having a diameter greater than a diameter of the opening in the second end of the housing structure. A nut is receivable on the terminal end of the propeller shaft. The nut is threadable on the propeller shaft to a tightened configuration wherein the nut engages the adaptor and maintains the propeller assembly on the propeller shaft. The nut, in the tightened configuration, the first side of the adaptor engages the second end of the bushing assembly and the enlarged portion of the adaptor is spaced from the second end of the housing structure.

24 Claims, 7 Drawing Sheets

(56) References Cited

U.S. PATENT DOCUMENTS

| | | | |
|---|---|---|---|
| 2009/0163089 | A1 | 6/2009 | Chen |
| 2014/0205455 | A1 | 7/2014 | Kuroki |
| 2015/0336647 | A1 | 11/2015 | Ariga |
| 2018/0105246 | A1 | 4/2018 | Kray et al. |

* cited by examiner

PROPELLER ASSEMBLY WITH NOISE REDUCING HUB ARRANGEMENT

FIELD OF THE INVENTION

This invention relates generally to marine propellers, and in particular, to a propeller assembly having a hub arrangement which translates rotational movement from a propeller shaft of a marine vehicle to the blades of a propeller and which reduces the noise generated by the propeller assembly during operation of an engine of the marine vehicle operatively connected to the propeller assembly.

BACKGROUND AND SUMMARY OF THE INVENTION

It is known to propel a marine vehicle utilizing a propeller assembly mounted on a rotatable shaft. The propeller assembly includes propeller blades extending from a central hub. A motor rotates the drive shaft which, in turn, rotates the central hub and the propeller blades. A hub assembly is provided to interconnect the central hub to the drive shaft. As is known, rotation of the propeller blades extending from the central hub propels the marine vehicle through the water.

Typically, the propeller assembly is constructed as a unit wherein the propeller blades, the central hub and the hub assembly are mounted or removed from the drive shaft in unison. Typically, the central hub of the propeller assembly includes an outer cylindrical housing which is welded or otherwise attached to a plurality of propeller blades. The central hub also includes an inner cylindrical housing which is co-axial with the outer cylindrical housing and radially spaced therefrom. The inner housing is supported within the outer housing by a plurality of circumferentially spaced ribs. The propeller assembly further includes a hub assembly disposed within the inner cylindrical housing of the propeller hub assembly. The hub assembly includes a drive member having an inner surface which meshes with splines on the outer surface of the drive shaft and an outer surface. A bushing formed from a rubber or elastomeric material is provided between the inner surface of the inner housing and the outer surface of the drive member. The elastomeric bushing provides shock absorbency between the propeller hub assembly and the drive shaft.

As is known, the drive shafts driven by the various motors for marine vehicles differ depending upon the manufacture. Consequently, individual propeller assemblies must be provided for the drive shafts of each motor brand. Maintaining an inventory of specific propellers for each brand of motor requires significant storage space and may be cost prohibitive. As such, in order to reduce the time and costs associated with replacing the propeller blades, it has been contemplated to provide a propeller assembly for a marine engine wherein the propeller blades project from a propeller housing that is removable from a central hub. By way of example, Chen, U.S. Pat. No. 7,717,678 discloses a propeller assembly for mounting on a propeller shaft of a watercraft. The propeller assembly includes a housing structure having a plurality of blades projecting radially therefrom. A bushing assembly translates rotational movement of the propeller shaft to the housing structure. The bushing assembly includes a spindle having an inner surface that meshes with the outer surface of a propeller shaft and a resilient bushing molded over the spindle. A plurality of spaced, longitudinally extending keys extend along the outer surface of the spindle. In the event that the propeller blades become fixed during operation of the watercraft, the keys fragment from the outer surface of spindle so as to disengage the spindle from the housing structure. In such manner, damage to the engine and to the drive system of the marine vehicle may be avoided.

While the advantages of a removable propeller housing are readily apparent, it can be appreciated that these types of propeller assemblies must be retained on the propeller shaft in such a manner as to limit any unnecessary movement of the propeller assembly that may reduce the overall efficiency of the drive system of the marine vehicle and to limit noise associated with operation of the propeller assembly when the marine engine is operated.

Therefore, it is a primary object and feature of the present invention to provide a propeller assembly that limits the noise associated with operation of the propeller assembly when a marine engine is operated.

It is a further object and feature of the present invention to provide a propeller assembly which permits limited continued rotation of the spindle and propeller shaft before disengaging the propeller shaft from the central hub and propeller assembly.

It is still a further object and feature of the present invention to provide a propeller assembly that may be simply and easily mounted on and removed from the propeller shaft of a marine vehicle.

In accordance with the present invention, a propeller assembly is provided for mounting on a rotatable propeller shaft having a terminal end. The propeller assembly includes a housing structure extending along a longitudinal axis and having first and second ends and an inner surface defining a cavity therein. The second end of the housing structure is defined by a terminal surface defining an opening in communication with the cavity in the housing structure. A spindle is receivable in the cavity of the housing structure. The spindle has first and second ends and an inner surface defining a passageway for receiving the propeller shaft therethrough. An adaptor has first and second sides, an opening between the first and second sides that is adapted for receiving the propeller shaft therethrough, and an enlarged portion having a diameter greater than a diameter of the opening in the terminal surface of the second end of the housing structure. A nut is receivable on the terminal end of the propeller shaft. The nut is threadable on the propeller shaft to a tightened configuration wherein the nut engages the adaptor and maintains the propeller assembly on the propeller shaft. With the nut in the tightened configuration, the first side of the adaptor engages the second end of the spindle and the enlarged portion of the adaptor is spaced from the second end of the housing structure.

The spindle includes an outer surface and a longitudinally extending key extends along the outer surface of the spindle. The inner surface of the housing structure includes a first portion being a first radial distance from the longitudinal axis and a second portion being a second radial distance from the longitudinal axis. The key includes a radially outer surface being a third radial distance from the longitudinal axis. The third radial distance is greater than the first radial distance and less than the second radial distance. The key fragments from the outer surface of the spindle in response to a predetermined force thereon.

The spindle further includes a bushing molded over the outer surface of the spindle. The bushing includes an outer surface engageable with an inner surface of the housing structure. The bushing is formed from a resilient material. The bushing has a generally square-shaped cross section and rounded corners. The inner surface of the spindle includes a plurality of longitudinally extending splines.

The inner surface of the housing structure has a generally square-shaped cross section. The inner surface of the housing structure is defined by first and second spaced sidewalls wherein the first and second sidewalls are tapered from the first end to the second end of the housing structure and by third and fourth spaced sidewalls wherein the third and fourth sidewalls are tapered from the first end to the second end of the housing structure. The inner surface of the housing structure is further defined by a first rounded corner interconnecting the first and third sidewalls; a second rounded corner interconnecting the third and second sidewalls; a third rounded corner interconnecting the second and fourth sidewalls; and a fourth rounded corner interconnecting the fourth and first sidewalls.

In accordance with a further aspect of the present invention, a propeller assembly is provided for mounting on a rotatable propeller shaft having a terminal end. The propeller assembly includes a housing structure extending along a longitudinal axis and having first and second ends and an inner surface defining a cavity therein. The second end of the housing structure is defined by a terminal surface defining an opening in communication with the cavity in the housing structure. A bushing assembly has first and second ends and is receivable in the cavity of the housing structure. The bushing assembly includes a spindle having an inner surface defining a passageway for receiving the propeller shaft therethrough; and a bushing molded over the spindle. The bushing has an outer surface engageable with the inner surface of the housing structure. An adaptor has first and second sides, an opening between the first and second sides that is adapted for receiving the propeller shaft therethrough, and an enlarged portion having a diameter greater than a diameter of the opening in the terminal surface of the second end of the housing structure. A nut is receivable on the terminal end of the propeller shaft. The nut is threadable on the propeller shaft to a tightened configuration wherein the nut engages the adaptor and maintains the propeller assembly on the propeller shaft. With the nut in the tightened configuration, the first side of the adaptor engages the second end of the bushing assembly and the enlarged portion of the adaptor is spaced from the second end of the housing structure.

The spindle includes an outer surface having a longitudinally extending key extending therealong. The key extends radially from the outer surface of the spindle. The bushing is formed from a resilient material. The inner surface of the spindle includes a plurality of longitudinally extending splines and the inner surface of the housing structure has a generally square-shaped cross section.

The adaptor includes a cylindrical body having a flange projecting radially therefrom. The flange defines the enlarged portion of the adaptor. The second side of the adaptor includes a recess formed therein. The recess communicates with the opening in the adaptor. The recess in the second side of the adaptor has a diameter greater than a diameter of the nut, such that the nut is at least partially received in the recess with the nut in the tightened configuration.

The inner surface of the housing structure is defined by first and second spaced sidewalls tapered toward each other from the first end to the second end of the housing structure; and third and fourth spaced sidewalls tapered toward each other from the first end to the second end of the housing structure.

A propeller assembly is provided for mounting on a rotatable propeller shaft having a terminal end. A housing structure extends along a longitudinal axis and has first and second ends. The housing structure includes an inner surface defining a cavity and an opening in the second end in communication with the cavity. A bushing assembly has first and second ends and includes an outer surface engageable with the inner surface of the housing structure. An adaptor has first and second sides and is adapted for receipt on the propeller shaft. The adaptor has an enlarged portion having a diameter greater than a diameter of the opening in the second end of the housing structure. A nut is receivable on the terminal end of the propeller shaft. The nut is threadable on the propeller shaft to a tightened configuration wherein the nut engages the adaptor and maintains the propeller assembly on the propeller shaft. With the nut in the tightened configuration, the first side of the adaptor engages the second end of the bushing assembly and the enlarged portion of the adaptor is spaced from the second end of the housing structure.

The adaptor includes a cylindrical body having a flange projecting radially therefrom. The flange defines the enlarged portion of the adaptor. The adaptor includes a passage therethrough for receiving the propeller shaft therethrough. The second side of the adaptor includes a recess formed therein. The recess communicates with the passage through the adaptor. The recess in the second side of the adaptor has a diameter greater than a diameter of the nut. The nut is at least partially received in the recess with the nut in the tightened configuration.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
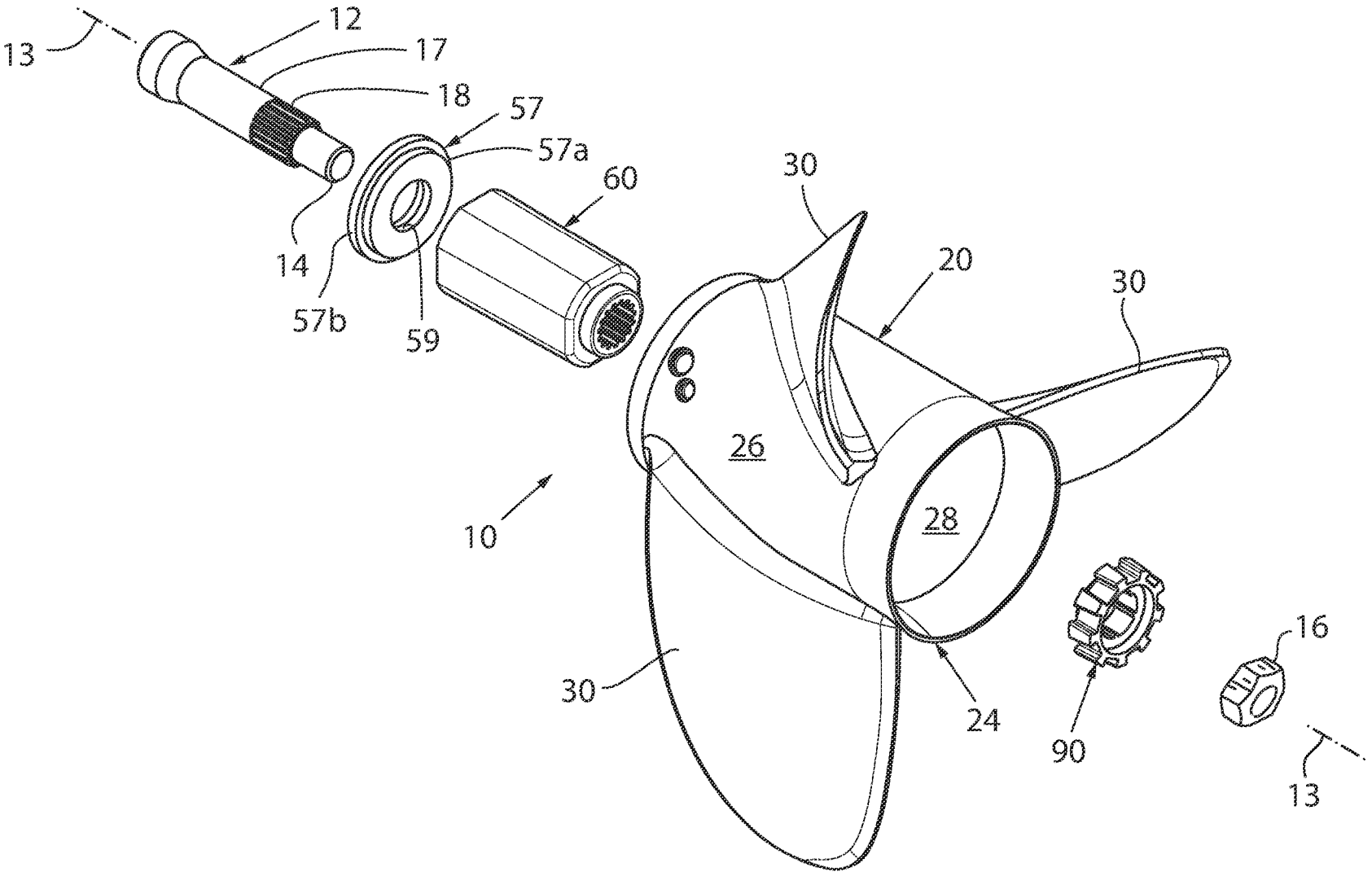
FIG. 1 is an exploded, isometric view of a propeller assembly of an embodiment of the present invention.

Referring to FIG. 1, a propeller assembly in accordance with the present invention is generally designated by the reference numeral 10. It is intended that propeller assembly 10 be mounted on a rotatable propeller shall 12 which, in turn, is driven by a marine engine (not shown). Propeller shaft 12 extends along a longitudinal axis 13 and terminates at a threaded terminal end 14 adapted for receiving a locking nut 16 thereon, for reasons hereinafter described. As is conventional, rotatable shaft 12 includes an outer surface 17 having longitudinally extending splines 18 therealong spaced from terminal end 14.

Referring to FIGS. 1-5, propeller assembly 10 includes a central hub 20 having a generally cylindrical inner housing 22 and a generally cylindrical outer housing 24. Outer housing 24 has an outer surface 26 and an inner surface 28. A plurality of circumferentially spaced propeller blades 30 project radially from outer surface 26 of outer housing 24. Inner surface 28 defines an inner housing receipt cavity 32 for receiving inner housing 22 therein. Outer surface 34 of inner housing 22 and inner surface 28 of outer housing 24 are rigidly connected by a plurality of circumferentially spaced connection spokes 38*a*-38*c* extend therebetween. Spokes 38*a*-38*c* are circumferentially spaced about outer surface 34 of inner housing 22.

Figure 7:
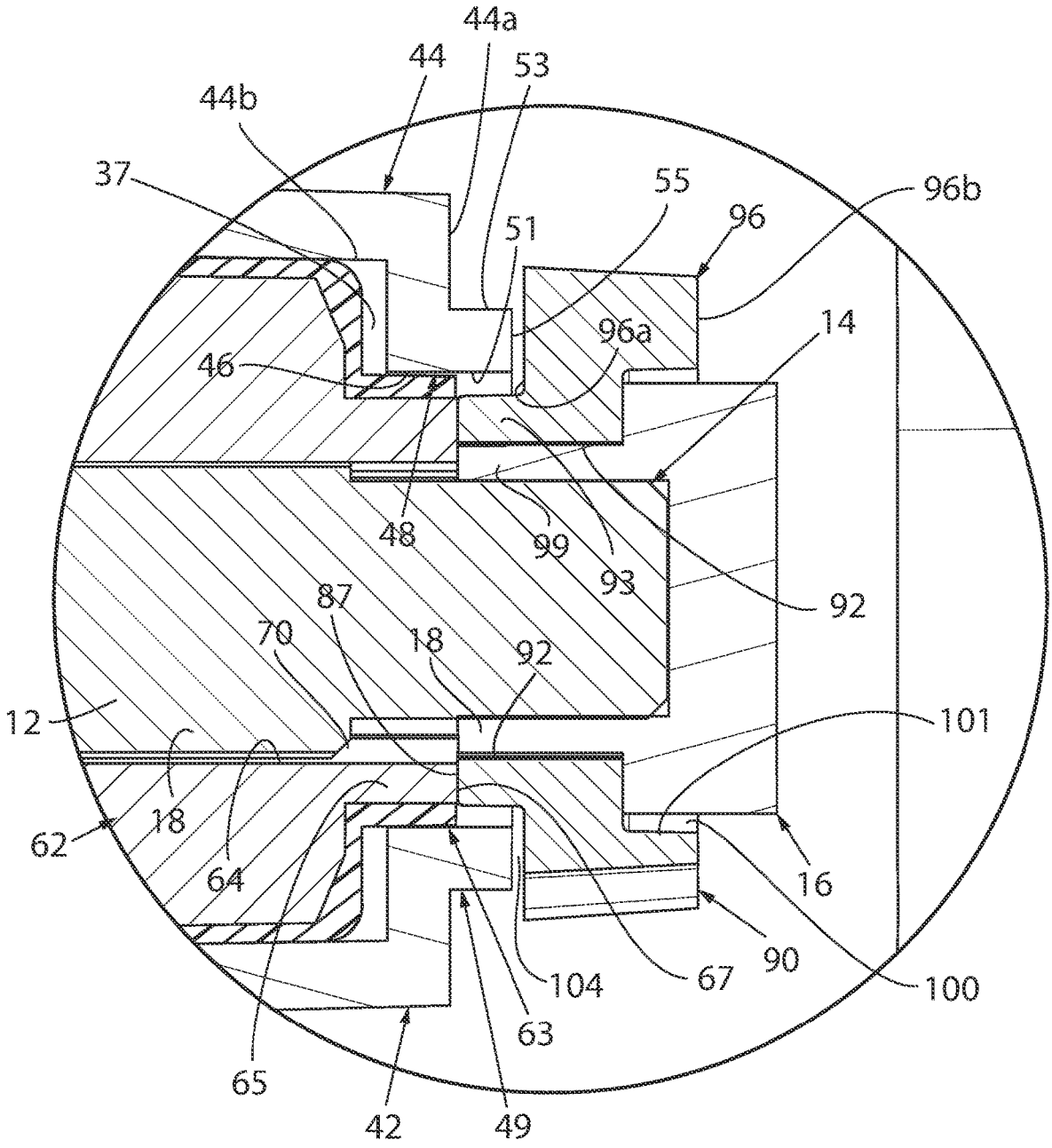
FIG. 7 is an enlarged cross-sectional view of the propeller assembly of the present invention taken along line 7 of FIG. 2.

Inner housing 22 of central hub 20 includes forward end 40, rearward end 42 and inner surface 36 extending therebetween along a central axis 43, coaxial with longitudinal axis 13, and defining inner cavity 37 for receiving bushing assembly 60, as hereinafter described. Inner housing 22 includes an opening 37*a* in forward end 40 thereof communicating to provide access to inner cavity 37, for reasons hereinafter described. As best seen in FIG. 7, end flange 44 projects radially inward from rearward end 42 of inner housing 22 and terminates at a radially inner surface 46 which partially defines generally circular opening 48. End flange 44 further includes an outer face 44*a* directed away from inner housing 22 and an inner face 44*b* communicating with and partially defining inner cavity 37. Ring-shaped lip 49 projects from outer face 44*a* of end flange 44 and includes an inner surface 51 concentric with radially inner surface 46 of end flange 44 and outer surface 53. Inner and outer surfaces 51 and 53, respectively, of lip 49 are interconnected by terminal surface 55 directed away from inner cavity 37. Inner surface 51 of lip 49 and inner surface 46 of end flange 44 define generally circular opening 48 in inner housing 22 to allow terminal end 14 of propeller shaft 12 to pass therethrough.

Referring back to FIGS. 3-4, inner surface 36 of inner housing 22 is partially defined by first, second, third and fourth circumferentially spaced, longitudinally extending faces 39*a*-39*d*, respectively. First and third faces 39*a* and 39*c*, respectively, face each other and are tapered such that first and third faces 39*a* and 39*c*, respectively, converge toward each other as first and third faces 39*a* and 39*c*, respectively, extend from forward end 40 to rearward end 42 of inner housing 22. Similarly, second and fourth faces 39*b* and 39*d*, respectively, face each other and are tapered so as to converge toward each other as second and fourth faces 39*a* and 39*c*, respectively, extend from forward end 40 to rearward end 42 of inner housing 22. It can be appreciated that as described, inner cavity 37 within inner housing 22 has a generally square cross-section. It can be appreciated that faces 39*a*-39*d* of inner surface 36 of inner housing 22 are at a maximum distance D1 from longitudinal axis 13 at forward end 40 of inner housing 22, FIG. 3, and at a minimum distance D2 from longitudinal axis 13 at rearward end 42 of inner housing 22, FIG. 4.

Figure 3:
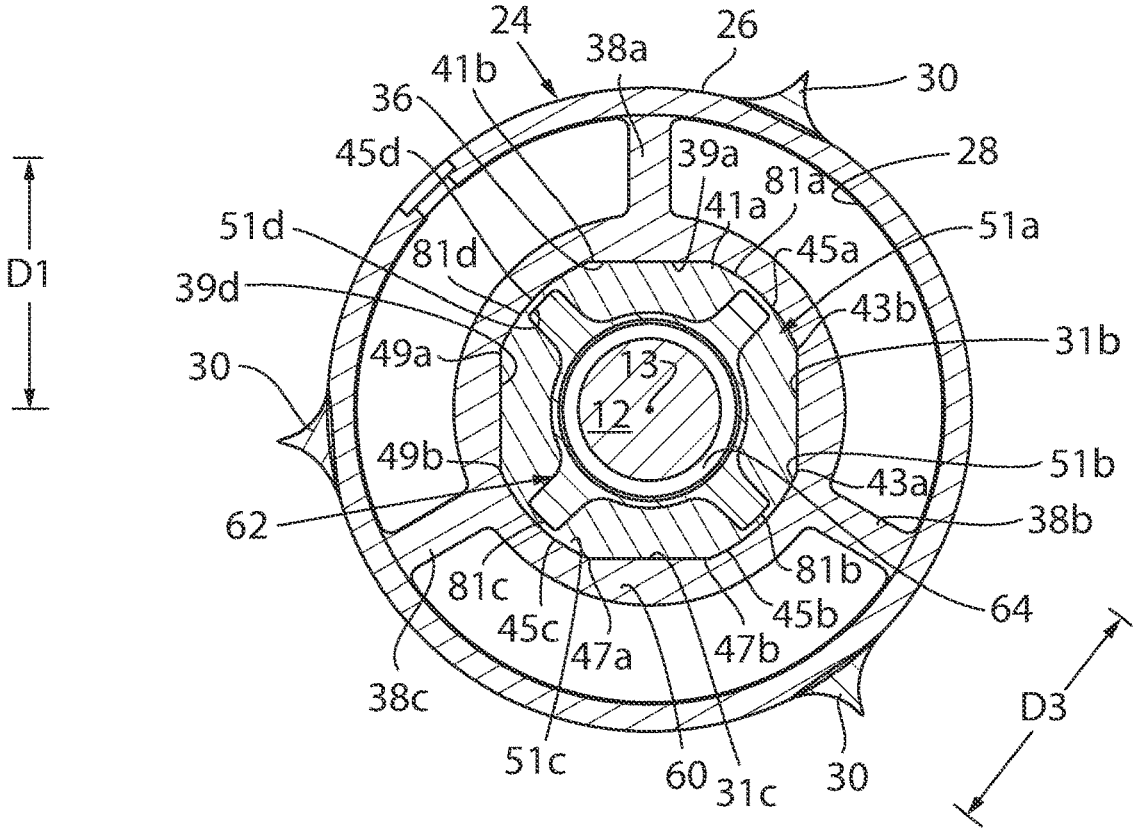
FIG. 3 is a cross-sectional view of the propeller assembly of the present invention taken along line 3-3 of FIG. 2.

As best seen in FIG. 3, first side 41*a* of first face 39*a* is interconnect to second side 43*b* of second face 39*b* by a generally arcuate, longitudinally extending first corner 45*a*. First side 43*a* of second face 39*b* is interconnect to second side 47*b* of third face 39*c* by a generally arcuate, longitudinally extending second corner 45*b*. First side 47*a* of third face 39*c* is interconnect to second side 49*b* of fourth face 39*d* by a generally arcuate, longitudinally extending third corner 45*c*. First side 49*a* of fourth face 39*d* is interconnect to second side 41*b* of first face 39*a* by a generally arcuate, longitudinally extending fourth corner 45*d*. It can be appreciated the inner surfaces 51*a*-51*d*, of corners 45*a*-45*d*, respectively, are at a maximum distance D3 from longitudinal axis 13 at forward end 40 of inner housing 22 and at a minimum distance D4 from longitudinal axis 13 at rearward end 42 of inner housing 22.

Figure 4:
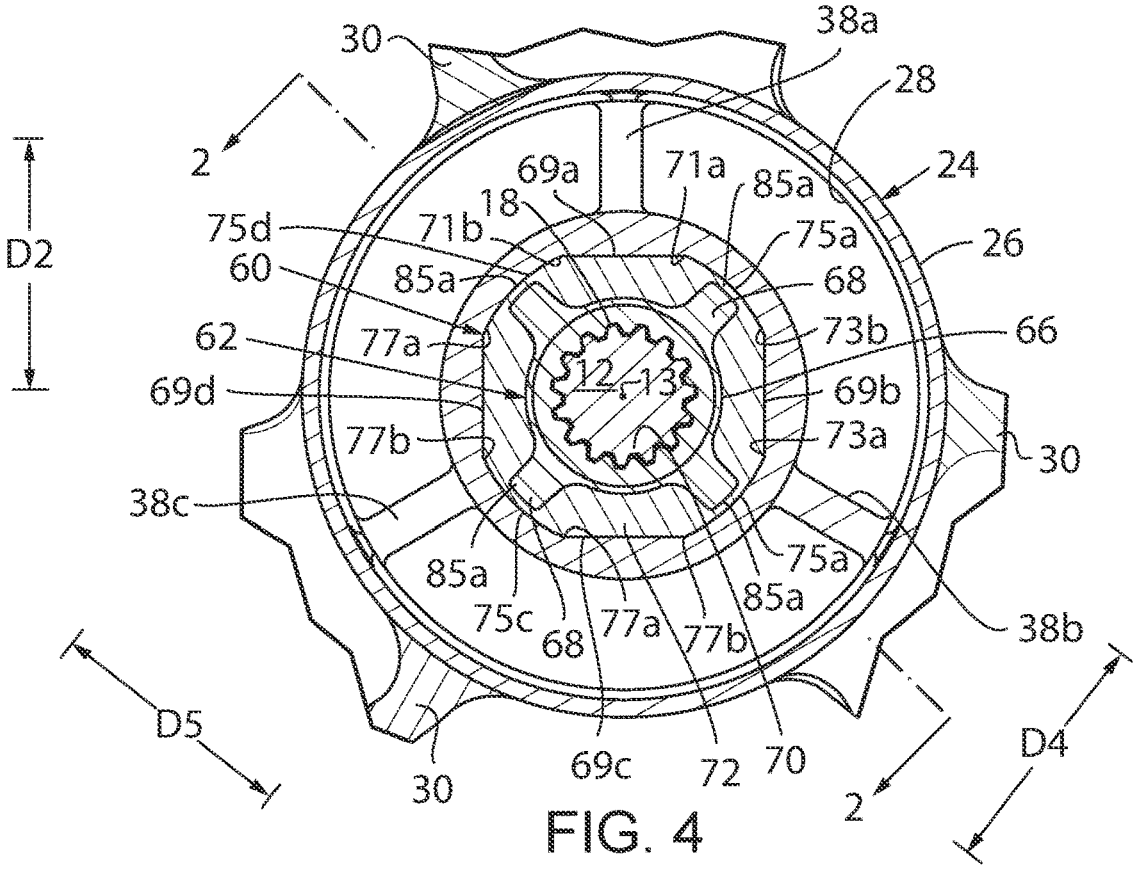
FIG. 4 is a cross-sectional view of the propeller assembly of the present invention taken along line 4-4 of FIG. 3.

As best seen in FIG. 4, propeller assembly 10 further includes bushing assembly 60 which is intended to translate rotation of propeller shaft 12 to central hub 20. Bushing assembly 60 includes spindle 62 having an inner surface 64 and a generally cylindrical outer surface 66. Inner surface 64 of spindle 62 includes a plurality of longitudinally extending splines 70 extending therealong which are intended to mesh with splines 18 extending along propeller shaft 12 when bushing assembly 60 is received thereon. A plurality of circumferentially spaced, longitudinally extending keys 68 project radially from outer surface 66 of spindle 62. Each key 68 is defined by a plurality of axially spaced key portions, e.g., key portions 68*a*-68*c* terminating at corresponding end surfaces 85*a*-85*c*, respectively. End surfaces 85*a*-85*c* of keys 68 are radially spaced from longitudinal axis 13 by a predetermined distance D5. For reasons hereafter described, distance D5 is greater than distance D2 and less than distance D4 and distance D1 is less than distance D4. It is contemplated for keys 68 to be frangible such that keys 68 disengage from outer surface 66 of spindle 62 in response to a predetermined force thereon.

Spindle 62 includes a forward end 61 and rearward end 63 having a reduced diameter portion 65 projecting therefrom. As best seen in FIG. 7, reduced diameter portion 65 of spindle 62 terminates at a generally flat, ring-shaped terminal surface 67 having an outer diameter less than or generally equally to the diameter of opening 48 in inner housing 22, for reasons hereinafter described.

Figure 2:
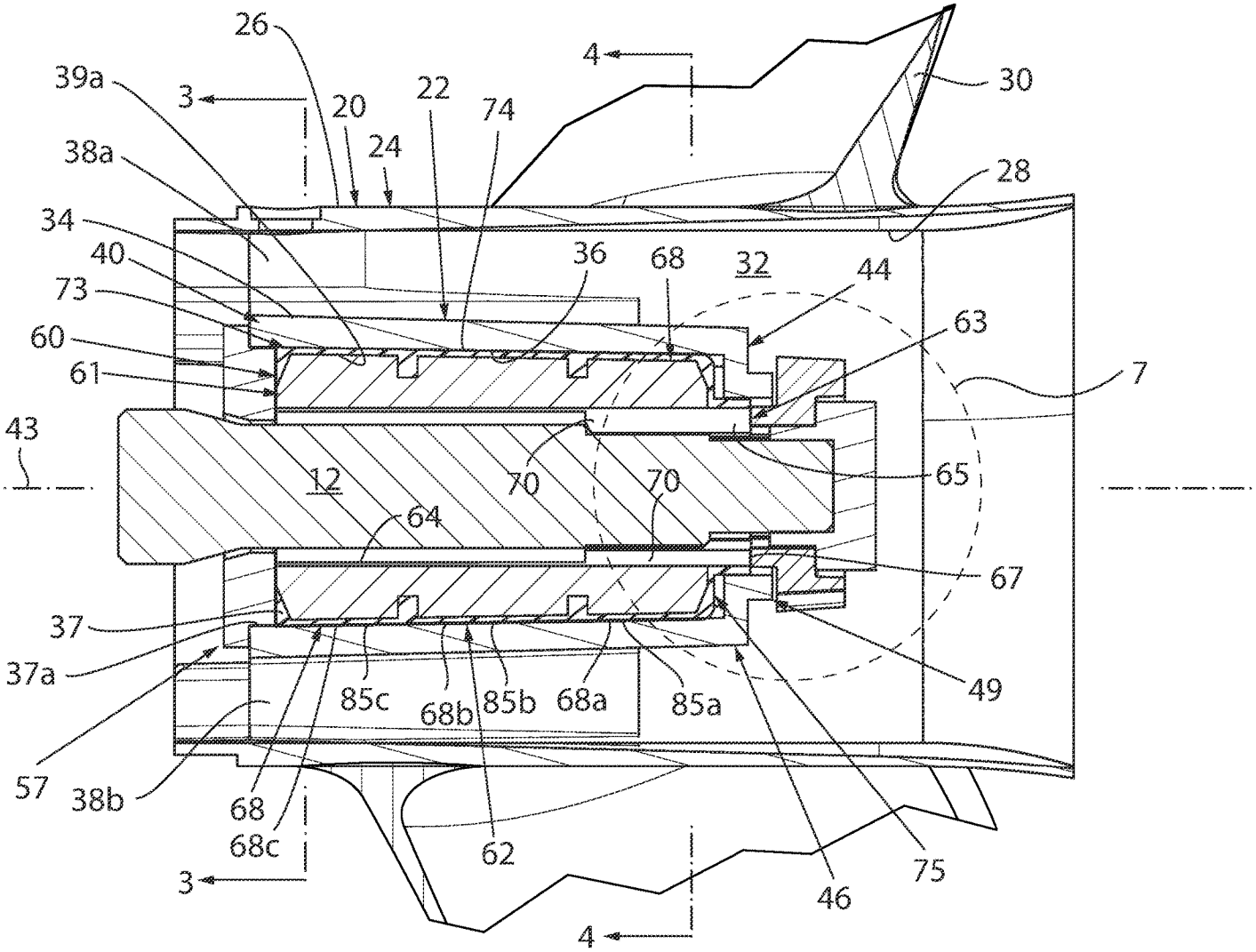
FIG. 2 is a cross-sectional view of the propeller assembly of the present invention taken along line 2-2 of FIG. 4.
Figure 2B:
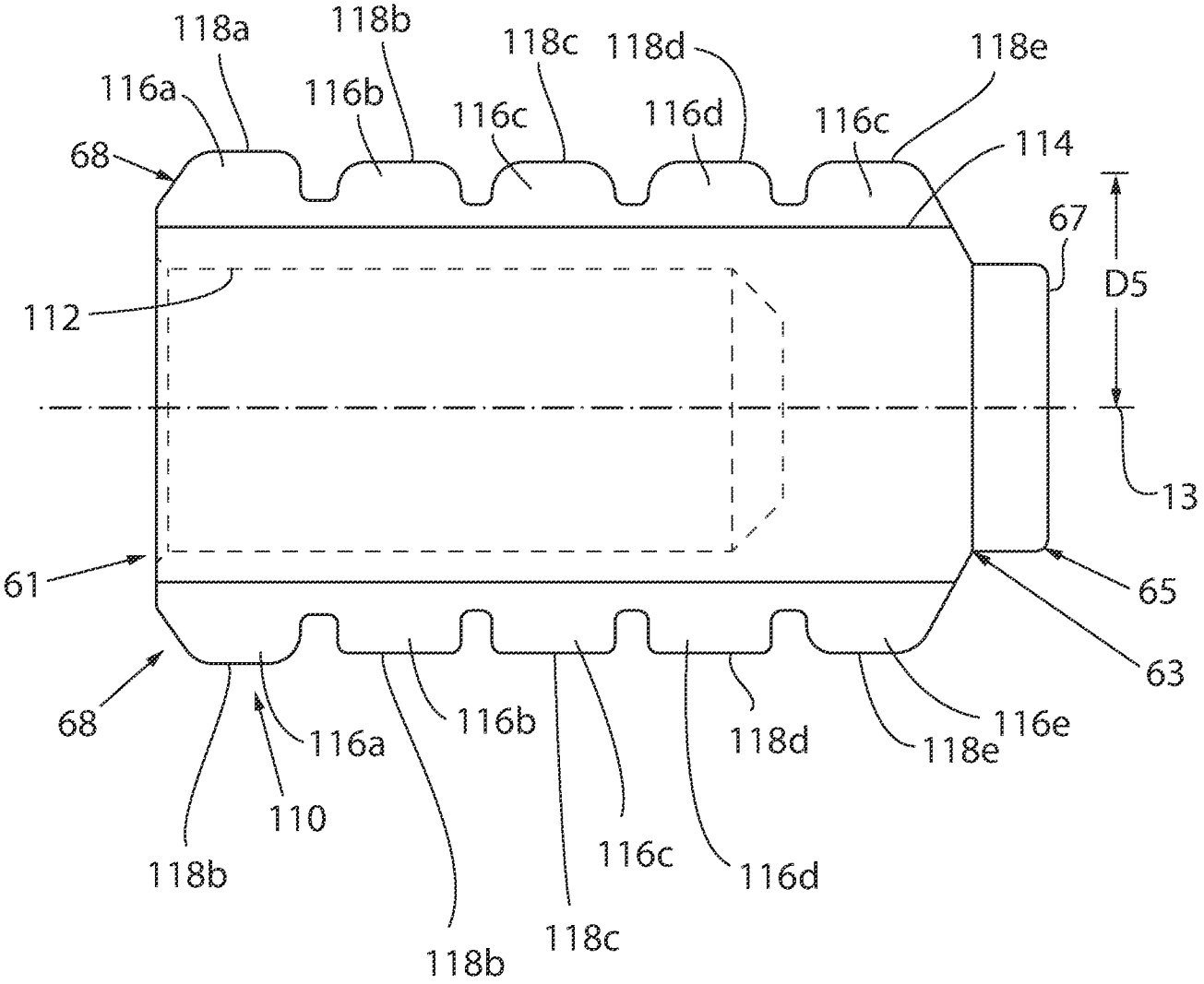
FIG. 2*b* is a side elevational view of an alternate configuration of a spindle for the propeller assembly of the present invention.

Referring to FIG. 2*b*, an alternate configuration of a spindle for use with bushing assembly 60 is generally designated by the reference numeral 110. As hereinafter described, spindle 110 is identical to spindle 62, but for number of key segments along the outer surface thereof. More specifically, spindle 110 has an inner surface 112 and a generally cylindrical outer surface 114. Inner surface 112 of spindle 110 includes a plurality of longitudinally extending splines (not shown) extending therealong which are intended to mesh with splines 18 extending along propeller shaft 12 when bushing assembly 60 is received thereon. In the alternate configuration of spindle 110, the plurality of circumferentially spaced, longitudinally extending keys 68 projecting radially from outer surface 114 of spindle 110 are defined by a plurality of axially spaced key portions, e.g., key portions 116*a*-116*e* terminating at corresponding end surfaces 118*a*-118*e*, respectively. End surfaces 118*a*-118*e* of key portions 116*a*-116*e*, respectively, are radially spaced from longitudinal axis 13 by predetermined distance D3. Again, as hereafter described, distance D5 is greater than distance D2 and less than distance D4. It can been understood that the number of key segments defining keys 68 along outer surface 114 of spindle 110 may be varied without deviating from the scope of the present invention.

Similar to spindle 62, it is contemplated for keys 68 of spindle 110 to be frangible such that keys 68 disengage from outer surface 114 of spindle 110 in response to a predetermined force thereon. Further, similar to spindle 62, spindle 110 includes a forward end 61 and rearward end 63 having a reduced diameter portion 65 projecting therefrom. Reduced diameter portion 65 of spindle 110 terminates at a generally flat, ring-shaped terminal surface 67 having an outer diameter less than or generally equally to the diameter of opening 48 in inner housing 22, for reasons hereinafter described.

Bushing assembly 60 further includes bushing 72 fabricated from any one of various resilient natural or synthetic materials which normally retain their molded shape, permit some flexing and distortion under shear, and resume their molded shape after the stress is removed. Bushing 72 includes forward end 73, rearward end 75 and outer surface 74 corresponding in shape to inner surface 36 of inner housing 22 of central hub 20, FIG. 2. More specifically, outer surface 74 of bushing 72 is partially defined by is partially defined by first, second, third and fourth circumferentially spaced, longitudinally extending faces 69*a*-69*d*, respectively. First and third faces 69*a* and 69*c*, respectively, converge toward each other as first and third faces 69*a* and 69*c*, respectively, extend from forward end 73 to rearward end 75 of bushing 72. Similarly, second and fourth faces 69*b* and 69*d*, respectively, converge toward each other as second and fourth 69*b* and 69*d*, respectively, extend from forward end 73 to rearward end 75 of bushing 72. Faces 69*a*-69*d* are at a maximum distance D1 from longitudinal axis 13 at forward end 73 of bushing 72 and at a minimum distance D2 from longitudinal axis 13 at rearward end 75 of bushing 72.

First side 71*a* of first face 69*a* is interconnect to second side 73*b* of second face 69*b* by a generally arcuate, longitudinally extending first corner 75*a*. First side 73*a* of second face 69*b* is interconnect to second side 77*b* of third face 69*c* by a generally arcuate, longitudinally extending second corner 75*b*. First side 77*a* of third face 69*c* is interconnect to second side 79*b* of fourth face 69*d* by a generally arcuate, longitudinally extending third corner 75*c*. First side 79*a* of fourth face 69*d* is interconnect to second side 71*b* of first face 69*a* by a generally arcuate, longitudinally extending fourth corner 75*d*. As described, bushing assembly 60 has a generally square-shaped cross section. For reasons hereinafter described, it can be appreciated the outer surfaces 81*a*-81*d*, of corners 75*a*-75*d*, respectively, are at a maximum distance D3 from longitudinal axis 13 at forward end 73 of bushing 72 and at a minimum distance D4 from longitudinal axis 13 at rearward end 75 of bushing 72. As best seen in FIGS. 3-4, bushing 72 is molded over a corresponding spindle, i.e., spindle 62 or spindle 110, such that keys 68 extend toward corresponding corners 75*a*-75*d*. It can be appreciated that bushing assembly 60 incorporating either spindle 62 or spindle 110 operatively functions in the same manner. As such, the description of assembly and operation of propeller assembly 10 with bushing assembly 60 including spindle 62 hereinafter is understood to describe the assembly and operation of propeller assembly 10 with bushing assembly 60 including spindle 110 as if fully described herein.

Referring back to FIGS. 1-4, in order to assemble propeller assembly 10, bushing assembly 60 is inserted into inner cavity 37 of inner housing 22 through opening 37*a* such that outer surface 74 of bushing 72 engages inner surface 36 of inner housing 22 and such that rearward end 76 of bushing assembly 60 is positioned against inner face 44*b* of end flange 44. More specifically, faces 69*a*-69*d* of bushing 72 engage corresponding faces 39*a*-39*d* of inner surface 36 of inner housing 22 and outer surfaces 81*a*-81*d* of corners 75*a*-75*d*, respectively, of bushing 72 engage corresponding inner surfaces 51*a*-51*d* of corners 45*a*-45*d*, respectively, of bushing 72. Plate 57 is positioned on forward end 40 of inner housing 22 such that reduced diameter portion 57*a* of plate 57 is received in inner cavity 37 of inner housing 22 though opening 37*a* and such that enlarged diameter portion 57*b* of plate 57 abuts toward end 40 of inner housing 22, whereby bushing assembly 60 is positioned within inner cavity 37 between inner face 44*b* of end flange 44 of inner housing 22 and reduced diameter portion 57*a* of plate 57.

In order to mount the propeller assembly 10 on propeller shaft 12, terminal end 14 of propeller shaft 12 is axially inserted through opening 59 in plate 57 and through bushing assembly 60 such that splines 18 on outer surface 17 of propeller shaft 12 mesh with splines 70 along inner surface 64 of spindle 62 and such that terminal end 14 of propeller shaft 12 extends through the opening 48 at rearward end 42 of inner housing 22, FIG. 7. An adaptor, such as spider washer 90, as hereinafter described, is positioned on terminal end 14 of propeller shaft 12 adjacent outer surface 44*a* of flange 44 of inner housing.

Figure 5:
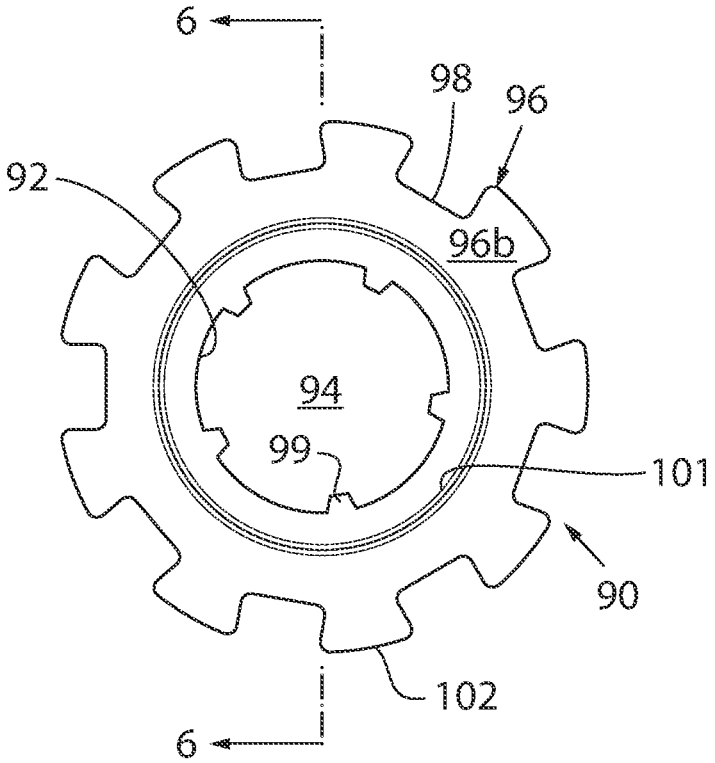
FIG. 5 is an end view of an adaptor for use with the propeller assembly of the present invention.
Figure 6:
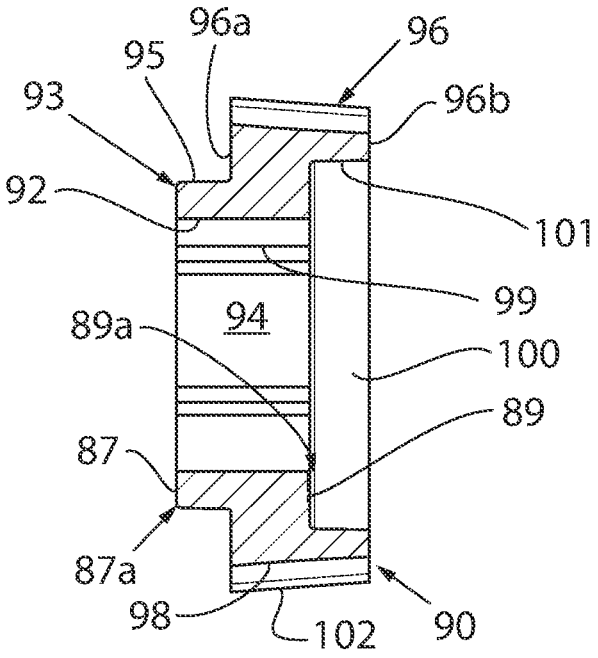
FIG. 6 is a cross-sectional view of the adaptor for the propeller assembly of the present invention taken along line 6-6 of FIG. 5.

Referring to FIGS. 5-7, spider washer 90 includes cylindrical body portion 93 having an inner surface 92 defining a passageway 94 therethrough and an outer surface 95. Inner and outer surfaces 92 and 95, respectively, are interconnected by first and second end surfaces 87 and 89, respectively, at opposite ends, 87*a* and 89*a*, respectively, of body portion 93. Longitudinally extending splines 99 extend along of inner surface 92 of spider washer 90 and are adapted to mesh with splines 18 of propeller shaft 12.

Spider washer 90 is further defined by flange portion 96 projecting radially outward from outer surface 95 of body portion 93. Flange portion 96 of spider washer 90 includes first and second faces 96*a* and 96*b*, respectively, interconnected by generally cylindrical terminal edge 98. It is contemplated for a plurality of circumferentially spaced tabs 102 to extend from terminal edge 98 of flange portion % of spider washer 90. Tabs 102 are adapted for receiving a tab washer (not shown) which may be provided by selected OEM manufacturers of marine drive equipment in order to help maintain propeller assembly 10 on drive shaft 12.

Second face 96*b* of flange portion 96 is interconnected to second end surface 89 of body portion 93 by cylindrical surface 101. Cylindrical surface 101 defines a recess or enlarged cavity in flange portion 96. Enlarged cavity 100 is in communication with passageway 94 and is of sufficient dimension to receive nut 16 threaded on terminal end 14 of propeller shaft 12 therein.

Spider washer 90 is positioned about propeller shaft 12 such that: 1) first end 87*a* of body portion 83 extends into opening 48 in inner housing 22; 2) splines 98 extending along of inner surface 92 of spider washer 90 mesh with splines 18 of propeller shaft 12; 3) first end surface 87 of body portion 93 of spider washer 90 engages terminal surface 67 of spindle 62; and 4) first face 96*a* of flange portion 96 of spider washer 90 is spaced from terminal surface 55 of lip 49 of inner housing 22, by gap 104. With spider washer 90 positioned on propeller shaft 12, as heretofore described, nut 16 is threaded on terminal end 14 of propeller shaft 12 to a tightened configuration such that first end surface 87 of body portion 93 of spider washer 90 is maintain against terminal surface 67 of spindle 62 thereby capturing bushing assembly 60 between nut 16 and reduced diameter portion 57*a* of plate 57 and retaining bushing assembly 60, and hence, propeller assembly 10 on propeller shaft 12. With nut 16 in the tightened configuration, first face 96*a* of flange portion 96 of spider washer 90 is spaced from terminal surface 55 of lip 49 of inner housing 22 by gap 104, thereby allowing limited axial movement of inner housing 22 with respect to bushing assembly 60. It can be appreciated that flange portion 96 of spider washer 90 retains inner housing 22 on propeller shaft 12. It has been found that by providing limiting axial movement of inner housing 22 with respect to bushing assembly 60 reduces the noise generated by propeller assembly 10 during operation of an engine of the marine vehicle operatively connected to propeller assembly 10.

Figure 8:
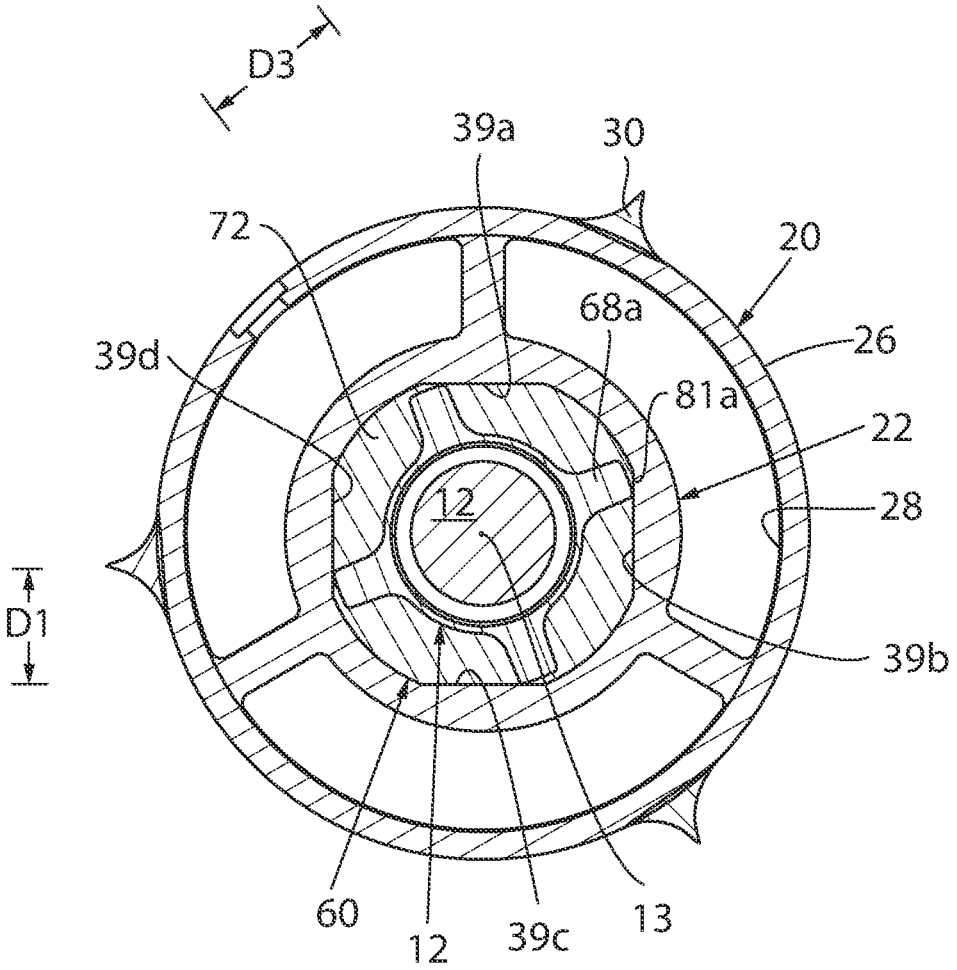
FIG. 8 is cross-sectional view of the propeller assembly of the present invention, similar to FIG. 3, showing the propeller assembly after engagement with an obstruction during operation.

As is conventional, meshed splines 18 and 70 of propeller shaft 12 and spindle 62, respectively, translate rotation of propeller shaft 12 to central hub 20 through bushing assembly 60. Rotation of the propeller blades 30 projecting from outer surface 26 of outer housing 24 propels a marine vehicle through the water. If propeller blades 30 become fixed due to engagement with an object in the w ater such that the propeller blades cannot rotate, it can be appreciated that the engine of the marine vehicle will continue to attempt to rotate propeller shaft 12. As a result, rotational force will be exerted on keys 68 projecting from outer surface 66 of spindle 62 by the propeller shaft 12. If the force on keys 68 exceeds a predetermined force, keys 68 will compress the bushing 72 and rotate. As shown in FIG. 8, keys 68 can only rotate a few degrees until keys 68 engage corresponding second sides 41*b*, 43*b*, 47*b* and 49*b* of corresponding faces 39*a*-39*d* of inner surface 36 of inner housing 22 since end surfaces 68*a* of keys 68 are a greater radial distance D5 from longitudinal axis 13 than the maximum and minimum distances D1 and D2, respectively, that faces 39*a*-39*d* are from longitudinal axis 13.

During operation of a marine vehicle in a body of water, rotation of propeller shaft 12 is translated to propeller assembly 10 such that propeller blades propel the marine vehicle through the body of water. In the event that propeller blades 30 become fixed due to engagement with an object in the water, it can be appreciated that the engine of the marine vehicle will continue to attempt to rotate propeller shaft 12. With propeller assembly 10 fixed by the object in the body of water, the rotational force generated by propeller shaft 12 on bushing assembly 60 will urge keys 68 into engagement with corresponding second sides 41*b*, 43*b*, 47*b* and 49*b* of corresponding faces 39*a*-39*d* of inner surface 36 of inner housing 22, as heretofore described. With keys 68 engaging corresponding second sides 41*b*. 43*b*, 47*b* and 49*b* of corresponding faces 39*a*-39*d* of inner surface 36 of inner housing 22, it is contemplated for keys 68 to fragment from outer surface 66 of spindle 62 in response to predetermined forces thereon. As a result, alter keys 68 fragment from outer surface 66 of spindle 62, bushing assembly 60 is free to rotate within cavity 37 of inner housing 22. In such manner, it is intended to avoid damage to the engine and to the drive system of the marine vehicle.

It can be appreciated that propeller assembly 10 may be assembled as heretofore described prior to the mounting thereof on propeller shaft 12. In such manner, bushing assembly 60 may be modified so as to adapt to various types of propeller shafts 12 produced by different manufacturers. In other words, utilizing a modified bushing assembly 60, propeller assembly 10 may be mounted on each of the various types of propeller shafts. Further, various modes of carrying out the invention are contemplated as being within the scope of the following claims particularly pointing out and distinctly claiming the subject matter which is regarded as the invention.

We claim:

1. A propeller assembly for mounting on a rotatable propeller shall having a terminal end, comprising:

a housing structure extending along a longitudinal axis and having first and second ends and an inner surface defining a cavity therein, the second end of the housing structure being defined by a terminal surface defining an opening in communication with the cavity in the housing structure;

a spindle receivable in the cavity of the housing structure, the spindle having first and second ends and an inner surface defining a passageway for receiving the propeller shaft therethrough;

an adaptor having first and second sides, an opening between the first and second sides and adapted for receiving the propeller shaft therethrough, and an enlarged portion having a diameter greater than a diameter of the opening in the terminal surface of the second end of the housing structure; and a nut receivable on the terminal end of the propeller shaft, the nut threadable on the propeller shaft to a tightened configuration wherein the nut engages the adaptor and maintains the propeller assembly on the propeller shaft;

wherein with the nut in the tightened configuration, the first side of the adaptor engages the second end of the spindle and the enlarged portion of the adaptor is spaced from the second end of the housing structure.

2. The propeller assembly of claim 1 wherein the spindle includes an outer surface and wherein the propeller assembly includes a longitudinally extending key extending along the outer surface of the spindle.

3. The propeller assembly of claim 2 wherein:

the inner surface of the housing structure including a first portion being a first radial distance from the longitudinal axis and a second portion being a second radial distance from the longitudinal axis;

the key including a radially outer surface being a third radial distance from the longitudinal axis; and the third radial distance is greater than the first radial distance and less than the second radial distance.

4. The propeller assembly of claim 2 wherein the key fragments from the outer surface of the spindle in response to a predetermined force thereon.

5. The propeller assembly of claim 1 wherein the spindle includes a bushing molded over the outer surface of the spindle, the bushing including an outer surface engageable with an inner surface of the housing structure.

6. The propeller assembly of claim 5 wherein the bushing is formed from a resilient material.

7. The propeller assembly of claim 6 wherein the bushing has a generally square-shaped cross section and rounded corners.

8. The propeller assembly of claim 1 wherein the inner surface of the spindle includes a plurality of longitudinally extending splines.

9. The propeller assembly of claim 1 wherein the inner surface of the housing structure has a generally square-shaped cross section.

10. The propeller assembly of claim 1 wherein the inner surface of the housing structure is defined by:

first and second spaced sidewalls, the first and second sidewalls being tapered from the first end to the second end of the housing structure; and third and fourth spaced sidewalls, the third and fourth sidewalls being tapered from the first end to the second end of the housing structure.

11. The propeller assembly of claim 10 wherein the inner surface of the housing structure is further defined by:

a first rounded corner interconnecting the first and third sidewalls;

a second rounded corner interconnecting the third and second sidewalls;

a third rounded corner interconnecting the second and fourth sidewalls; and a fourth rounded corner interconnecting the fourth and first sidewalls.

12. A propeller assembly for mounting on a rotatable propeller shaft having a terminal end, comprising:

a housing structure extending along a longitudinal axis and having first and second ends and an inner surface defining a cavity therein, the second end of the housing structure being defined by a terminal surface defining an opening in communication with the cavity in the housing structure;

a bushing assembly having first and second ends and being receivable in the cavity of the housing structure, the bushing assembly including:

a spindle having an inner surface defining a passageway for receiving the propeller shaft therethrough; and a bushing molded over the spindle, the bushing having an outer surface engageable with the inner surface of the housing structure;

an adaptor having first and second sides, an opening between the first and second sides and adapted for receiving the propeller shaft therethrough, and an enlarged portion having a diameter greater than a diameter of the opening in the terminal surface of the second end of the housing structure; and a nut receivable on the terminal end of the propeller shaft, the nut threadable on the propeller shaft to a tightened configuration wherein the nut engages the adaptor and maintains the propeller assembly on the propeller shaft; wherein with the nut in the tightened configuration, the first side of the adaptor engages the second end of the bushing assembly and the enlarged portion of the adaptor is spaced from the second end of the housing structure.

13. The propeller assembly of claim 11 wherein the spindle includes an outer surface having a longitudinally extending key extending therealong, the key extending radially from the outer surface of the spindle.

14. The propeller assembly of claim 11 wherein the bushing is formed from a resilient material.

15. The propeller assembly of claim 11 wherein the inner surface of the spindle includes a plurality of longitudinally extending splines.

16. The propeller assembly of claim 11 wherein the inner surface of the housing structure has a generally square-shaped cross section.

17. The propeller assembly of claim 11 wherein the adaptor includes a cylindrical body having a flange projecting radially therefrom, the flange defining the enlarged portion of the adaptor.

18. The propeller assembly of claim 11 wherein the second side of the adaptor includes a recess formed therein, the recess communicating with the opening in the adaptor.

19. The propeller assembly of claim 18 wherein the recess in the second side of the adaptor has a diameter greater than a diameter of the nut, such that the nut is at least partially received in the recess with the nut in the tightened configuration.

20. The propeller assembly of claim 11 wherein the inner surface of the housing structure is defined by:

first and second spaced sidewalls, the first and second sidewalls being tapered toward each other from the first end to the second end of the housing structure; and third and fourth spaced sidewalls, the third and fourth sidewalls being tapered toward each other from the first end to the second end of the housing structure.

21. A propeller assembly for mounting on a rotatable propeller shaft having a terminal end, comprising:

a housing structure extending along a longitudinal axis and having first and second ends, the housing structure including an inner surface defining a cavity and an opening in the second end in communication with the cavity;

a bushing assembly having first and second ends and including an outer surface engageable with the inner surface of the housing structure;

an adaptor having first and second sides and being adapted for receipt on the propeller shaft, the adaptor having an enlarged portion having a diameter greater than a diameter of the opening in the second end of the housing structure; and a nut receivable on the terminal end of the propeller shaft, the nut threadable on the propeller shaft to a tightened configuration w herein the nut engages the adaptor and maintains the propeller assembly on the propeller shaft; wherein with the nut in the tightened configuration, the first side of the adaptor engages the second end of the bushing assembly and the enlarged portion of the adaptor is spaced from the second end of the housing structure.

22. The propeller assembly of claim 21 wherein the adaptor includes a cylindrical body having a flange projecting radially therefrom, the flange defining the enlarged portion of the adaptor.

23. The propeller assembly of claim 21 wherein the adaptor includes a passage therethrough for receiving the propeller shaft therethrough and wherein the second side of the adaptor includes a recess formed therein, the recess communicating with the passage through the adaptor.

24. The propeller assembly of claim 23 wherein the recess in the second side of the adaptor has a diameter greater than a diameter of the nut, such that the nut is at least partially received in the recess with the nut in the tightened configuration.

* * * * *